US005484473A

United States Patent [19]

Bontempi

[11] Patent Number: 5,484,473

[45] Date of Patent: Jan. 16, 1996

[54] TWO-STAGE ELECTROSTATIC FILTER WITH EXTRUDED MODULAR COMPONENTS PARTICULARLY FOR AIR RECIRCULATION UNITS

[76] Inventor: Luigi Bontempi, Via Lombardi 14/16, Calvisano (Brescia), Italy

[21] Appl. No.: 276,912

[22] Filed: Jul. 19, 1994

[30] Foreign Application Priority Data

Jul. 28, 1993 [IT] Italy ..... MI93A1693

[51] Int. Cl.[6] ..... B03C 3/51

[52] U.S. Cl. ..... 96/65; 96/71; 96/96; 96/100

[58] Field of Search ..... 96/100, 71, 65, 96/96; 95/78

[56] References Cited

U.S. PATENT DOCUMENTS

| | | | |
|---|---|---|---|
| 1,400,795 | 12/1921 | Bradley | 96/65 |
| 3,282,029 | 11/1966 | Steuernagel | 96/71 |
| 4,725,289 | 2/1988 | Quintilian | 96/100 X |

FOREIGN PATENT DOCUMENTS

| | | | |
|---|---|---|---|
| 0714821 | 11/1931 | France . | |
| 1268819 | 6/1961 | France | 96/100 |
| 2583657 | 12/1986 | France | 96/96 |
| 0664834 | 8/1938 | Germany . | |
| 62-110753 | 5/1987 | Japan . | |
| 859870 | 1/1961 | United Kingdom | 96/100 |

*Primary Examiner*—Richard L. Chiesa
*Attorney, Agent, or Firm*—Ladas & Parry

[57] ABSTRACT

A two-stage electrostatic filter is provided for air recirculation units. The filter includes at least one ionization stage (100) formed by parallel facing walls, in which a high-potential electrode (50) is located, and at least one precipitation stage (200) formed by parallel walls of negative potential in relation to the ionization stage. The ionization and precipitation stages-include at least one inverted U-shaped cathode (10), the opposite ends of which are mechanically and electrically integral with a transverse supporting section (20) and within which is provided at least one baffle (**10*b*) extending parallel to outer arms (10*a*) of the U-shaped cathode, but with a height lower than that of the arms. The cathode (10) cooperates with a U-shaped anode (30; 1030) counterposed thereto and rendered mechanically integral by insulated supports (40). There are also provided further cathodes (110*b*; 2110*b***) for the modular expansion of the filter in the direction of its width.

7 Claims, 2 Drawing Sheets

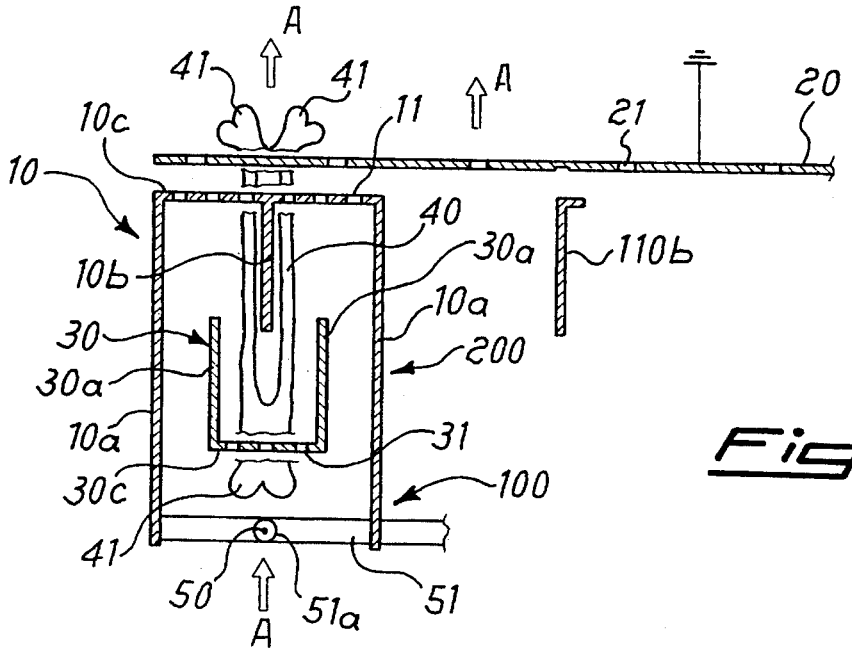
Fig. 1
Fig. 2
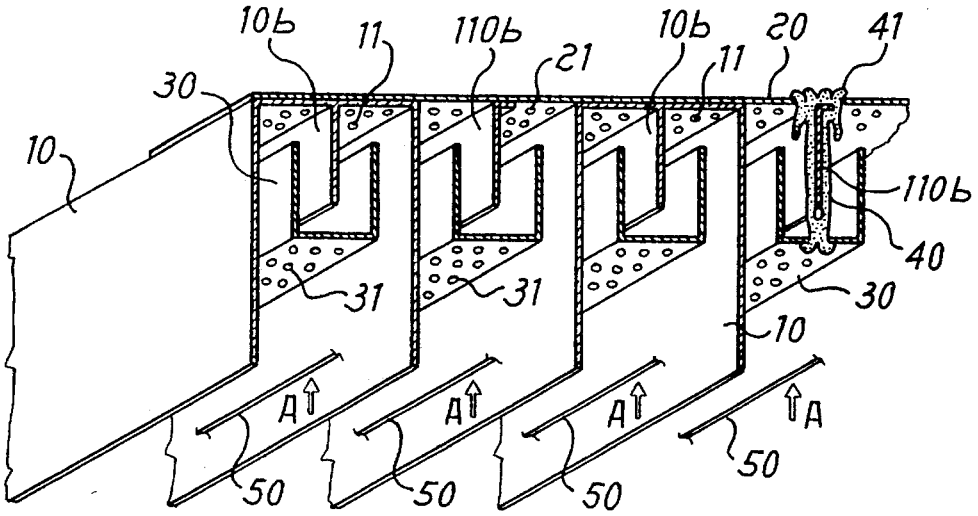
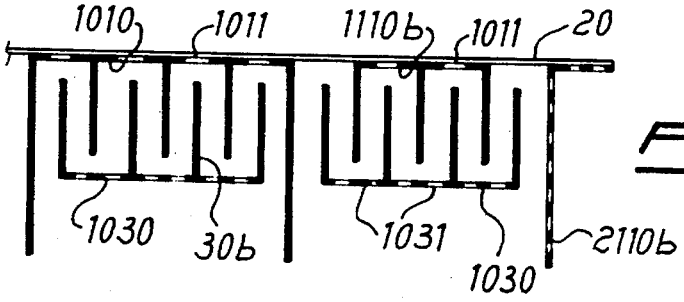
Fig. 3a

TWO-STAGE ELECTROSTATIC FILTER WITH EXTRUDED MODULAR COMPONENTS PARTICULARLY FOR AIR RECIRCULATION UNITS

The object of this invention is a two-stage electrostatic filter particularly for air recirculation units, which is comprised of extruded modular components capable of being linked mechanically and in circuit to form a single filter body dimensioned for the required volume of air to be filtered and a particle-collecting section capable of being removed separately from the ionizing electrode.

BACKGROUND OF THE INVENTION

As is known, electrostatic filters for the filtration of air provide for the passage of such air through an ionization zone or section, comprising a high-potential polarizing electrode in which the suspended solid particles are electrostatically charged, and for the passage of such ionized particles via routes delimited by walls charged with opposite sign to that of the particles, which are thereby attracted to the said walls on which they settle in a stable manner.

Such electrostatic filters may be substantially of two types: so-called single-stage filters in which the ionization section and the collecting section are combined in a single section, and so-called two-stage filters in which the two sections are separated and placed in succession to one another, each section having its own electric field. In both cases, the filter may be of single-body type, that is, consisting of a single unit housing both sections, or of dual-body type, that is, with the components comprising the two sections being physically different and capable of being separated from one another. Within the field of two-stage filters there are known filters of both single-body type and dual-body type which, however, have very limited structural geometries and are difficult to adapt to the different filtering capacities required in different applications, in addition to which their manufacture is extremely laborious and specialized, with high costs of assembly of the parts.

A further constraint of the filters of known type lies in the fact that for normal washing operations it is necessary to remove the ionizing electrode, thus increasing the risk of breakage, and in that a short-circuit even in a limited zone would adversely affect the performance of the entire filter which would effectively be fully short-circuited. There is therefore posed the technical problem of providing a two-stage filter capable of being made from a minimum number of readily assemblable parts and with a geometrical configuration capable of being achieved and/or modified in a very simple manner in relation to the specific requirements of individual applications. The filter should furthermore be simple and inexpensive to construct and assemble, easily applicable to purification equipment and capable of making it possible to achieve the most constant possible performance in time with low maintenance, while also reducing the damage caused by the handling of the ionizing electrode.

SUMMARY OF THE INVENTION

Such results are obtained with the present invention which provides a two-stage electrostatic filter for air recirculation units, comprising at least one ionization stage formed by parallel facing walls in which is located a high-potential electrode, and at least one precipitation stage formed by parallel walls of negative potential in relation to the ionization stage, in which such ionization and precipitation cells are comprised of at least one cathode of inverted "U shape" the opposite ends of which are mechanically and electrically integral with a transverse supporting section and within which is provided at least one baffle extending parallel to the outer arms of the "U" throughout the length of the section but with a height lower than that of the said arms and capable of cooperating with a U-shaped anode counterposed thereto and rendered mechanically integral by means of insulated supports, there being also provided further cathodes for the modular expansion of the filter in the direction of its width.

According to one method of implementation, such cathode and anode are extruded and furthermore comprise respectively a multiplicity of baffles lower in height than the arms of the cathode, and a multiplicity of inner baffles equal in height to the outer arms and in number matching that of the cathode baffles plus one.

Provision is also made for the ionizing wire to be integral with a frame comprising at least two insulated sides supporting the said wire and capable of being linked to an air recirculation unit.

According to this invention provision is also made for such further cathodes for the modular expansion of the filter to consist of frame members of inverted "L" shape respectively equal in height to the baffle located inside the cathodes and to the outer arms of such cathode.

BRIEF DESCRIPTION OF THE DRAWINGS

Further details may be obtained from the following description, given with reference to the attached drawings which show:

In FIG. 1: an exploded schematic cross-section of the basic components making up the modular filter according to the invention;

In FIG. 2: a schematic cross-section of a filter made with the components in FIG. 1;

DETAILED DESCRIPTION OF THE PREFERRED EMBODIMENT

Figures 3, 4:
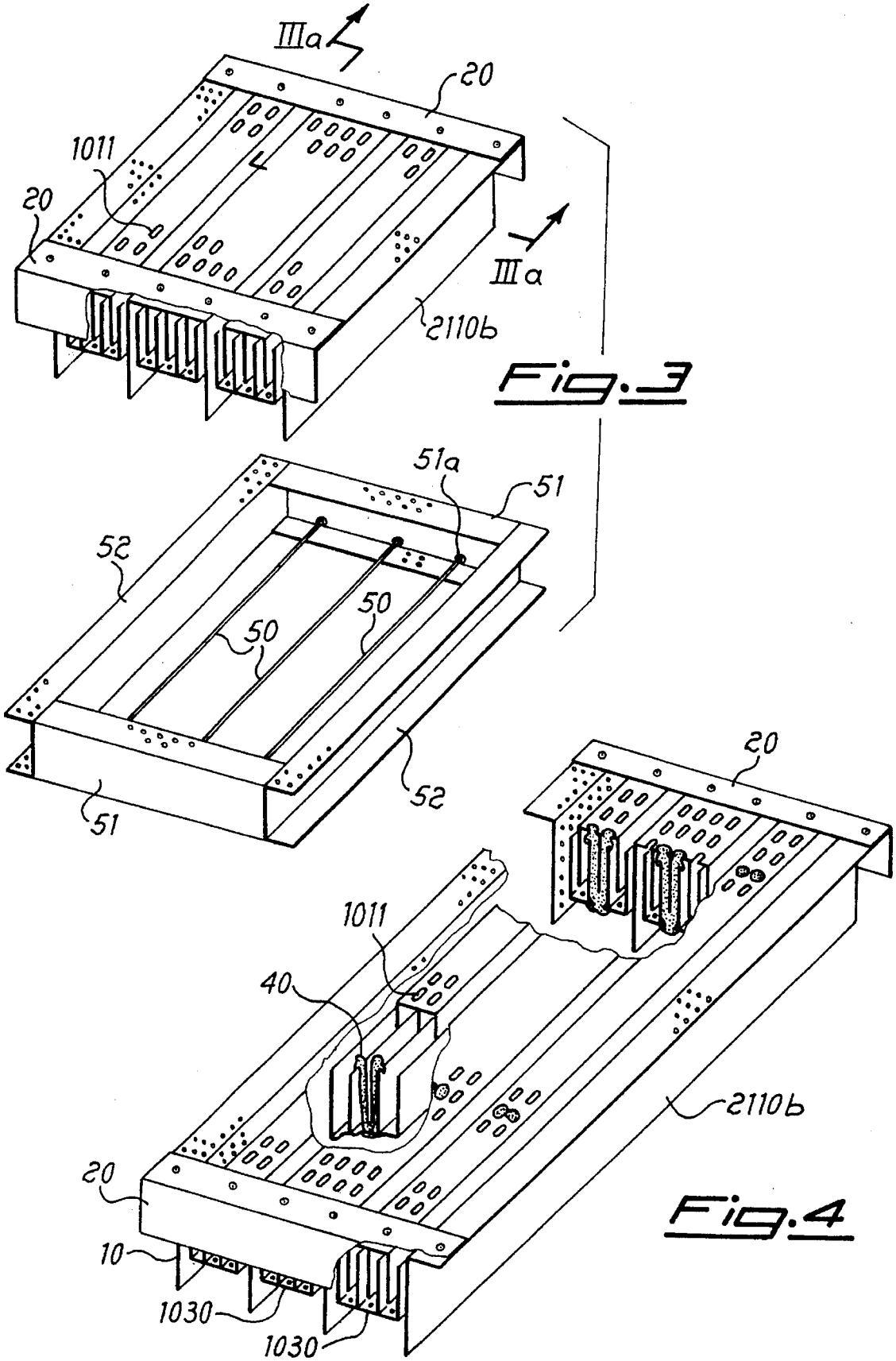
In FIG. 3: an exploded view with partial dismantling of a preferred method of implementation of an electrostatic filter according to the invention; and In FIG. 3*a*: a cross-section according to plotting plane IIIa—IIIa of FIG. 3.
In FIG. 4: a cross-sectional view of the filter in FIG. 3 assembled and expanded in the direction of the length.

With reference to FIG. 1, the electrostatic filter according to the invention consists of a cathode 10 of inverted U shape made of conducting material, such as for example aluminium or metallized plastic, vertical arms 10*a* of which are extended to a height greater than that of a middle baffle 10*b* integral with base 10*c* of the inverted U and extending throughout the length of such U section parallel to it arms 10*a*.

In base 10*c* of the inverted U are furthermore provided holes 11 capable of allowing either the passage of air which, by means of devices which are self-evident and therefore not illustrated, is forced through the filter in the direction of arrows A, or the passage of insulated components 40, as described more clearly hereinafter.

Such cathode 10 is made integral by means of screws or the like with a section 20 of conducting material extending crosswise in relation to cathode 10. Section 20 therefore provides both physical means of support and means for the electrical connection of cathode 10 to the negative potential of the final electric circuit.

Inside the cathode and counterposed to baffle 10*b* is inserted an anode 30 consisting of a U-shaped transverse section, arms 30*a* of which thus come to be interposed between arms 10*a* and baffle 10*b* of cathode 10. Additionally, at base 30*c* of anode 30 are provided holes 31 for the passage of air and of insulated support 40.

As shown in the figures, such insulated support 40 is formed, in one method of implementation, of a component of substantially "V" shape the vertices of which have flexible extensions 41 capable of becoming deformed so as to allow the passage through holes 11 and 31 of cathode 10 and anode 30, with consequent stable attachment on emerging from such holes. By this means it is possible to achieve a stable mechanical attachment between anode 30 and cathode 10 which, however, remain electrically isolated from one another as required for the correct operation of the filter.

In the zone comprised between the lengths of arms 10*a* of cathode 10 extending beyond base 20*c* of anode 30 is inserted high-potential wire 50 for the ionization of the airborne particles.

As illustrated more clearly by the arrangement in FIG. 3, such wire is held by a pair of opposing insulated crosspieces 51 provided with through holes 51*a* and made integral with two C-shaped sections 52; in this manner there is formed a frame which may be made integral with the air recirculation unit (not illustrated).

The frame and hence wire 50 are therefore secured to the unit while the cathode body which collects the particles may be removed easily and with great safety for the operations of washing and/or geometrical modification.

In order to facilitate the modular expansion of the basic arrangement of the filter according to the invention, provision is also made for the inclusion of a further cathode formed by a frame 110*b* of inverted "L" shape capable of being made mechanically and electrically integral with section 20.

Because of their special configuration, all the components making up the filter may be manufactured by extrusion, thus making possible high production rates at controlled cost. Additionally, as is apparent from FIG. 2, an electrostatic filter may be dimensioned at will both in a longitudinal sense, by simply extending the length of the individual components, and in a transverse sense by increasing the number of cathodes and anodes placed side by side.

From FIG. 2 it is furthermore apparent that to conducting section 20 there have been made integral further cathodes 10 and anodes 30 between insulated components 40.

The operation of the filter is as follows: ionizing electrode 50 is charged with positive high potential and in turn positively charges anode 30 located in front of the said wire. Transverse section 20 is instead connected to earth, thus bringing about a negative potential relative to that of the anodes in all cathodes 10 and 110*b*. By this means, electrode 50 and the portion of arms 10*a* of cathode 10 extending beyond anode 30 constitute a first stage 100 of ionization, while the remaining part of cathode 10 and anode 30 form a second section 200 of precipitation and collection of the airborne particles, which after being ionized in first stage 100 are forced through second stage 200 within which they are repelled by the positive anodic field of anode 30 and attracted by cathode walls 10*a* and 10*b* of opposite sign, on which they settle in a stable manner while the air flows out through holes 11.

As illustrated in FIGS. 3 and 3*a*, the arrangement of the filter may also be expanded by lengthening the walls of the individual components. In this case cathode baffles 10*b* inside cathode 10 remain unchanged and only increase in number; correspondingly there is also expanded anode 1030 within which are provided baffles 30*b* in number matching that of cathode baffles 10*b* so as to provide precipitation chambers delimited by the walls with an electric charge of opposite sign.

Additionally, frame 110*b* is expanded and becomes a multi-baffle component 1110*b* capable of being connected to an anode 1030 in a manner alike to that envisaged for cathode 10.

Where transverse expansion is brought about by an equal number of components, thus not making it possible to begin and end the succession of cathode cells with an inverted U-shaped component 1010, provision is made for a further component 2110*b* of inverted "L" shape functionally analogous to cathode 110*b* but equal in height to arms 10*a* of cathode 10, through which it is possible to form the last cathode wall of containment of the ionizing wire determining the end ionization stage. As illustrated in FIG. 4, the electrostatic filter according to the invention may also be expanded in a longitudinal direction by simply using cathodes and anodes as described above, but of greater length. Such increased length may also be obtained by simply cutting to size the basic extruded components.

It is therefore obvious that it is possible to obtain electrostatic filters easily and economically adaptable to the most diverse requirements from a reduced number of basic components obtained by extrusion and capable of modular combination. It is furthermore apparent that it is possible to reduce the risks of damage associated with the handling of the ionizing electrode which, according to the invention, does not need to be removed for the regular washing of the precipitation section, and that any short-circuit in limited zones of the filter is not passed on to other zones thereof, thus limiting the lowering of performance of the said filter.

I claim:

1. A two-stage electrostatic filter for air recirculation units, comprising at least one ionization stage formed by parallel facing walls in which is located a high-potential electrode, and at least one precipitation stage formed by parallel walls of negative potential in relation to the ionization stage, wherein said ionization and precipitation stages are comprised of at least one inverted U-shaped cathode, the opposite ends of which are mechanically and electrically integral with a transverse supporting section and within which is provided at least one baffle extending parallel to outer arms of the U-shaped cathode throughout the length of the section but with a height lower than that of said arms and having means for cooperating with a U-shaped anode counterposed thereto and rendered mechanically integral by means of insulated supports, there being also provided further cathodes for the modular expansion of the filter in the direction of its width.

2. A two-stage electrostatic filter according to claim 1, wherein said cathodes and anodes are extruded.

3. A two-stage electrostatic filter according to claim 1, wherein said cathodes comprise a multiplicity of baffles lower in height than said arms of said cathode.

4. A two-stage electrostatic filter according to claim 1 or 3, wherein said anodes comprise a multiplicity of inner baffles equal in height to said outer arms and in number matching that of said cathode baffles plus one.

5. A two-stage electrostatic filter according to claim 1, wherein an ionizing wire is integral with a fixed frame comprising at least two insulated sides supporting said wire and having means for linking to an air recirculation unit.

6. A two-stage electrostatic filter according to claim 5, wherein the ionization and precipitation stages form a single body reversibly attachable to said fixed frame carrying the ionizing wire.

7. A two-stage electrostatic filter according to claim 1, wherein said further cathodes for the modular expansion of the filter consist of frame members of inverted L shape respectively equal in height to said baffle located inside the cathode and to said outer arms of the cathode.

* * * * *